United States Patent [19]

Trichell et al.

[11] Patent Number: 4,667,405

[45] Date of Patent: May 26, 1987

[54] COMBINED CLIPPER AND VACUUM ASSEMBLY

[76] Inventors: John Trichell, 301 A East Dr.; Ronald M. Wheeler, 2606 Drummond St., both of, Vicksburg, Miss. 39180

[21] Appl. No.: 760,569

[22] Filed: Aug. 26, 1985

Related U.S. Application Data

[62] Division of Ser. No. 569,961, Jan. 11, 1985, Pat. No. 4,563,814.

[51] Int. Cl.[4] ..... B26B 19/44

[52] U.S. Cl. ..... 30/41.5; 30/41

[58] Field of Search ..... 30/41, 41.5, 133, 201

[56] References Cited

U.S. PATENT DOCUMENTS

| | | | |
|---|---|---|---|
| 2,297,735 | 10/1942 | Allen | 30/41.5 X |
| 2,542,333 | 2/1951 | Hotz et al. | 30/41.5 X |
| 2,929,140 | 3/1960 | Wilson | 30/41.5 X |
| 4,077,122 | 3/1978 | Rollor, Jr. et al. | 30/41.5 X |

*Primary Examiner*—E. R. Kazenske
*Assistant Examiner*—Fridie, Jr.: Willmon
*Attorney, Agent, or Firm*—Laubscher & Laubscher

[57] ABSTRACT

A disposable hair clipping head assembly adapted for attachment to an electric clipper is disclosed. The assembly is characterized by a novel two-piece construction including fixed and movable members formed of synthetic plastic material. The fixed member includes a base and an integral spring having a portion thereof extending in parallel spaced relation from the base. One edge of the fixed member base contains a plurality of teeth. The movable member is arranged between the spring and base of the fixed member, with the spring serving to retain the movable member which is adapted for reciprocal movement relative to the base. One edge of the movable member also contains a plurality of teeth which are arranged adjacent the teeth of the fixed member. The fixed member also includes a pair of lugs integrally connected with the spring, the lugs being adapted for interlocking attachment to the electric clipper. When the clipping head assembly is attached to the clipper and the movable member is driven thereby, the clipping head assembly is operable to clip strands of hair between the teeth of the fixed and movable member. A vacuum assembly is also provided to remove the cut strands of hair.

1 Claim, 8 Drawing Figures

COMBINED CLIPPER AND VACUUM ASSEMBLY

This is a division, of application Ser. No. 569,961 filed Jan. 11, 1985 now U.S. Pat. No. 4,563,814.

BACKGROUND OF THE INVENTION

The present invention relates to a combined clipper and vacuum assembly designed specifically for use in hospitals for removing body hair from a patient in preparation for surgery. The assembly includes a unique disposable sterile clipper head which facilitates the maintenance of sterile conditions in an operating room.

BRIEF DESCRIPTION OF THE PRIOR ART

Electric hair clippers and cutting heads therefor are well known in the patented prior art as evidenced by the patents to Oster, U.S. Pat. No. 2,928,171, Sadlon, U.S. Pat. No. 3,222,782, and Andis, U.S. Pat. No. 4,328,616. The poster patent, for example, discloses a conventional three piece cutting head assembly including a stationary bottom blade, a movable top blade, and a spring member. Each piece of the assembly is formed of metal, and the assembly is connected together with a pair of screws. The cutting head assembly is removably connected with the body of an electric clipper by way of a tongue and strip assembly.

The Sadlon patent discloses a four-piece cutting assembly held together by screws and including two shearing blades, an assembly yoke, and a spring. Finally, Andis discloses an even more complex seven-piece cutting head assembly wherein the fixed and movable blades are each of laminated two-piece construction.

While the prior devices normally operate quite satisfactorily, they each possess a number of inherent drawbacks which reduce their practicality for use in a hospital environment. Specifically, each of the prior devices comprises a relatively complex and expensive assembly. Where any of the prior devices is to be used in an operating room to remove hair from a patient about to undergo surgery, it is necessry to insure that the cutting head is sterile. Accordingly, after every use, the head must be removed from the clipper for sterilization. Moreover, in order to completely sterilize the head, it is often necessary that the head be disassembled. The repeated disassembly and sterilization of the head is a time-consuming and costly procedure. Moreover, when the cutting blades have become worn, it is necessary either to sharpen the blades or replace the head, again adding to the maintenance costs of the device.

Also known in the prior art are various vacuum assemblies used in connection with a cutting device as evidenced by the patents to Barcaskey, U.S. Pat. No. 3,273,237 and Flicker, U.S. Pat. No. 3,975,821. The Barcaskey patent discloses a hair clipper connected with a vacuum cleaner or other suction pump for removing cut hair. The Flicker patent discloses a combined cutter and vacuum assembly for cutting plaster casts and for removing any dust resulting from the cast cutting.

Neither of the prior cutter and vacuum assemblies is suitable for use in the removal of body hair from tender areas of a patient since the degree of suction is not controllable in accordance with the area being cut.

The present invention was developed to overcome these and other drawbacks of the prior art by providing an inexpensive disposable cutting head assembly adapted for use in connection with a vacuum device to cut and remove body hair from a patient in preparation for surgery.

SUMMARY OF THE INVENTION

Accordingly, it is a primary object of the present invention to provide a disposable clipping head assembly of two-piece construction comprising fixed and movable members. The fixed member includes a rectangular planar base portion having one toothed edge. A spring is integrally connected with and extends from the upper planar surface of the base portion. The spring includes a forwardly extending portion spaced from and parallel with the upper surface of the base. The forwardly extending portion terminates at a forward edge spaced rearwardly from the toothed edge of the base. A pair of lugs extend upwardly from the upper edge of the spring and are adapted for interlocking attachment to an electric clipper. The movable member is arranged between the base and spring of the fixed member and also has a rectangular planar configuration and a toothed edge arranged adjacent the toothed edge of the fixed member. The upper surface of the movable member contains a groove spaced from and parallel with the toothed edge, the groove being adapted to receive the forward edge of the spring of the fixed member. Accordingly, the spring retains and guides the movable member relative to the fixed member when the fixed member is attached to an electric clipper which drives the movable member for reciprocal movement to clip strands of hair between the adjacent toothed edges.

According to a more particular object of the invention, the disposable clipper head is formed of acrylic synthetic plastic material treated with gamma radiation for sterilization.

It is a further object of the invention to use the disposable clipper head in connection with a combined hair clipping and vacuum assembly including a hair clipper and a vacuum device for removing strands of hair cut by the clipping head. The vacuum device includes a vacuum source, a nozzle mounted on the clipper and containing an opening arranged adjacent the clipping head, a suction hose arranged between the nozzle and the vacuum source to provide suction for the nozzle, and a control device for the vacuum source to vary the degree of suction provided for the nozzle opening.

BRIEF DESCRIPTION OF THE FIGURES

Other objects and advantages will become apparent from a study of the following specification when viewed in the light of the accompanying drawing, in which.

DETAILED DESCRIPTION

Figure 1:
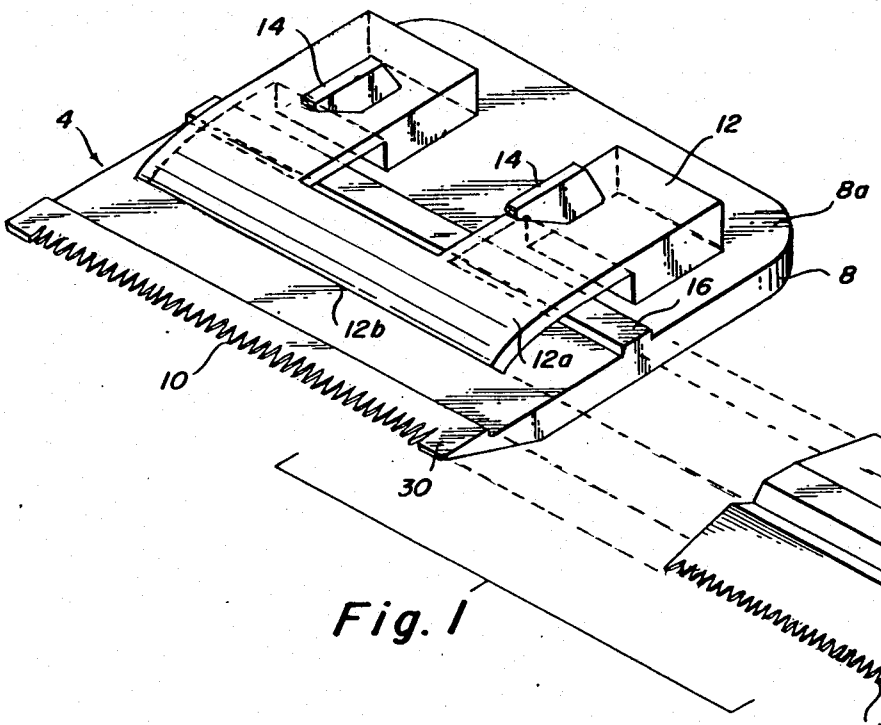
FIG. 1 is an exploded perspective view of the two piece disposable clipping head according to the invention.
Figure 1:
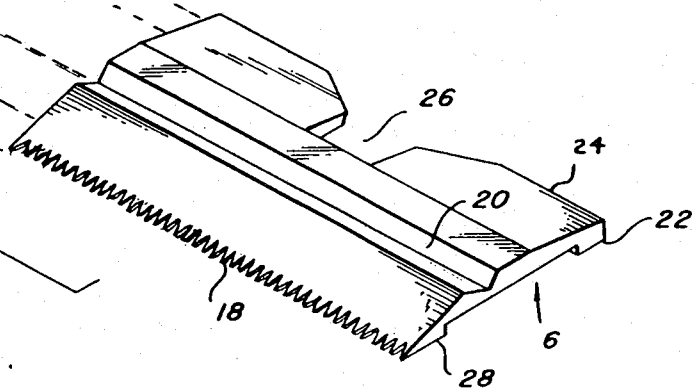

The disposable clipping head assembly 2 of the subject invention is illustrated in detail in FIG. 1–4. As shown in FIG. 1, the clipping head comprises only two pieces, namely, a fixed member 4 and a movable member 6.

The fixed member 4 includes a base 8 having a generally planar rectangular configuration. The forward edge of the base includes a plurality of teeth 10. The fixed member is formed with an integral spring 12 which extends upwardly from the upper planar surface 8*a* of the base. A portion 12*a* of the spring extends forwardly toward the toothed edge of the base 8. The forwardly extending portion 12*a* is spaced from and generally parallel with the upper surface 8*a* of the fixed member base, and terminates at an edge 12*b* spaced from the toothed edge of the base.

Figure 2:
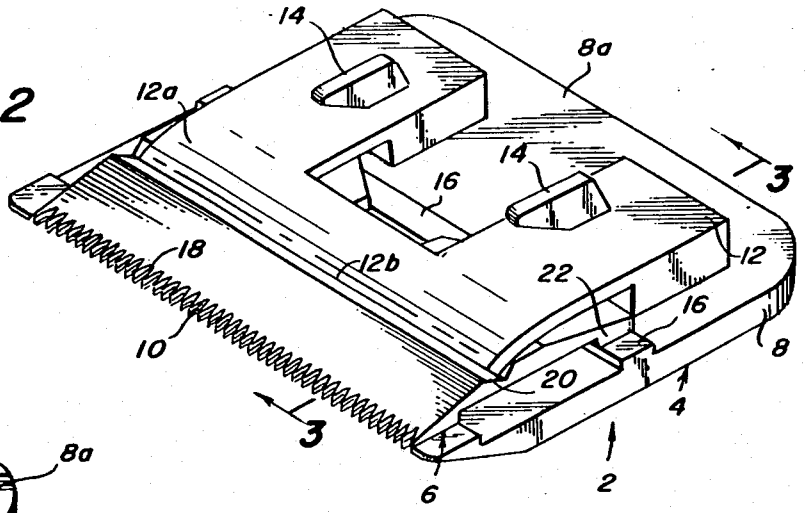
FIG. 2 is a perspective view of the clipping head in its assembled condition.

As shown in FIGS. 1 and 2, the spring, when viewed from the top, has a generally U-shaped configuration. Extending upwardly from each leg of the U-shaped spring is an integral lug 14 which assists in attaching the fixed member to an electric clipper as will be developed in greater detail below.

The fixed member base 8 also includes an integral ridge 16 extending upwardly from the upper planar surface. The ridge is arranged parallel with and spaced from the toothed forward edge of the base. The ridge 16 preferably extends continuously between the side edges of the base beneath the forward portion 12*a* of the spring.

The movable member 6 also has a generally planar rectangular configuration and includes a plurality of teeth 18 in the forward edge thereof. The upper surface of the movable member contains a groove 20 parallel with and spaced from the front toothed edge. The groove extends continuously between the side edges of the movable member. The bottom surface of the movable member includes an integral ridge 22 arranged adjacent the rear edge 24 and parallel with the front toothed edge. The rear edge 24 of the movable member also contains an enlarged recess 26 adapted to receive a drive shaft or spindle of an electric clipper as will be developed more fully below.

Figure 3:
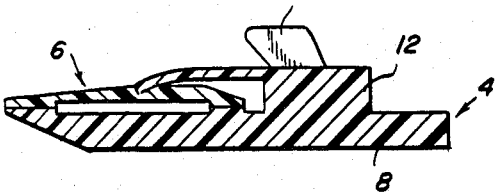
FIG. 3 is a cross-sectional view of the assembled clipping head taken along line 3—3 of FIG. 2.
Figure 4:
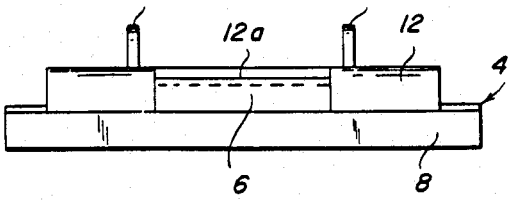
FIG. 4 is a rear plan view of the assembled clipping head.

As shown in FIGS. 2, 3, and 4, with the cutting head 2 assembled, the movable member 6 is arranged between the spring 12 and base 8 of the fixed member 4. More particularly, the lower ridge 22 of the movable member rests on the corresponding ridge 16 of the base 8 of the fixed member, and the toothed forward edges 18, 10 of the movable and fixed members are arranged adjacent one another. The toothed portion 18 of the movable member 6 is preferably vertically offset as at 28 from the bottom planar surface thereof. Similarly, the toothed portion 10 of the fixed member 8 is preferably vertically offset as at 30 from the upper planar surface 8*a* of the base. Accordingly, with the movable member resting on the base of the fixed member, the offset portions 28 and 30 are in contiguous relation as are the corresponding ridges 16 and 22.

The front edge 12*b* of the spring is arranged within the groove 20 in the upper edge of the movable member 6. The spring 12 is resilient, whereby the spring front edge 12*a* exerts a biasing force against the top surface of the movable member to retain the movable member in its assembled condition.

The fixed and movable members are both molded from synthetic plastic material such as acrylic. It will be readily apparent to those skilled in the art that the rigidity and resiliency of the clipping head assembly will vary in accordance with the properties of the material being used. Synthetic plastic materials are preferred because they are less costly than metals used in prior clipping heads, whereby a synthetic plastic clipping head may be disposed of after use. Other characteristics of the synthetic plastic materials are that they are light weight and yet have sufficient strength and resiliency for use as a cutting head. Moreover, the synthetic plastic cutting head assembly according to the subject invention may be sterilized after its assembly and then packaged in a sterile condition for shipping to the ultimate user. One preferred method of sterilization is to expose the cutting head to gamma radiation which is quick and efficient.

In order to reinforce the clipping head, the synthetic plastic material from which the fixed and movable members of the head are molded may be reinforced with glass fibers or small metal particles. These additives also assist the toothed edges of the fixed and movable members in retaining their sharpness, thereby preventing the dulling of the clipping head during its use. Moreover, where metal particles are used in the synthetic plastic material, the particles are preferably magnetized to assist in attaching the clipping head to an electric clipper.

Figure 5:
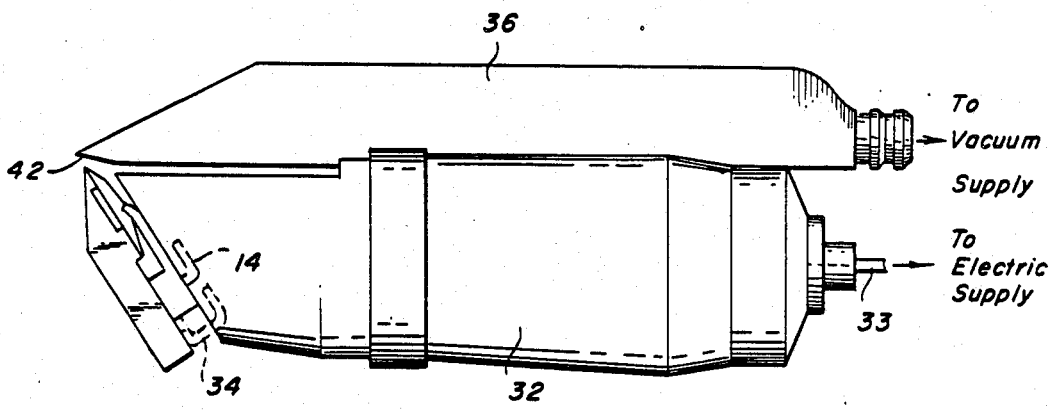
FIG. 5 is a side plan view of an electric clipper having the clipping head and a suction nozzle mounted thereon.

The clipping head 2 is attached to an electric clipper in a manner similar to the attachment disclosed in the Oster U.S. Pat. No. 2,928,171. As shown in FIG. 5, the electric clipper 32 includes a tongue 34 which fits within the spring and base of the fixed member of the clipper head assembly. A strap (not shown) cooperates with the tongue to removably attach the head assembly to the electric clipper. Furthermore, the lugs 14 extending upwardly from the spring 12 of the fixed member 6 guide the head and interlock with the clipper. The clipper includes a drive shaft (not shown) which extends into the recess 26 of the movable member to reciprocally drive the movable member relative to the fixed member in a conventional member.

By properly controlling the resiliency of the spring 12 and thus the biasing force exerted by the spring on the movable member 6, the ease of reciprocal movement of the driven movable member is established. Friction between the movable and fixed members is reduced owing to the provision of the ridges 16, 22 and the offsets 28, 30 which reduce the surface area contact between the members.

The disposable sterile clipping head is particularly suitable for use with an electric clipper to remove body hair from a patient in preparation for surgery. In order to maintain a sterile environment it is desirable to remove strands of hair that have been cut by the clipping head. Accordingly, as shown in FIGS. 5–7, the electric clipper and disposable clipping head are preferably used together with a vacuum assembly.

The vacuum assembly includes a nozzle 36 mounted on the electric clipper 32, a vacuum source 38 (FIG. 7), and a hose 40 (FIG. 6) connecting the vacuum source with the nozzle. As shown in FIG. 5, the nozzle includes an opening 42 arranged adjacent the clipping head assembly 2 attached to the clipper 32. The opening is adapted to receive the strands of hair as they are cut by the clipping head. The cut hairs are transported through the nozzle 36, the hose 40 to a disposable bag 44 adjacent the vacuum source 38. A conventional variable speed motor 46 such as a squirrel cage vacuum motor drives the vacuum source to provide suction to the hose and nozzle.

Figure 7:
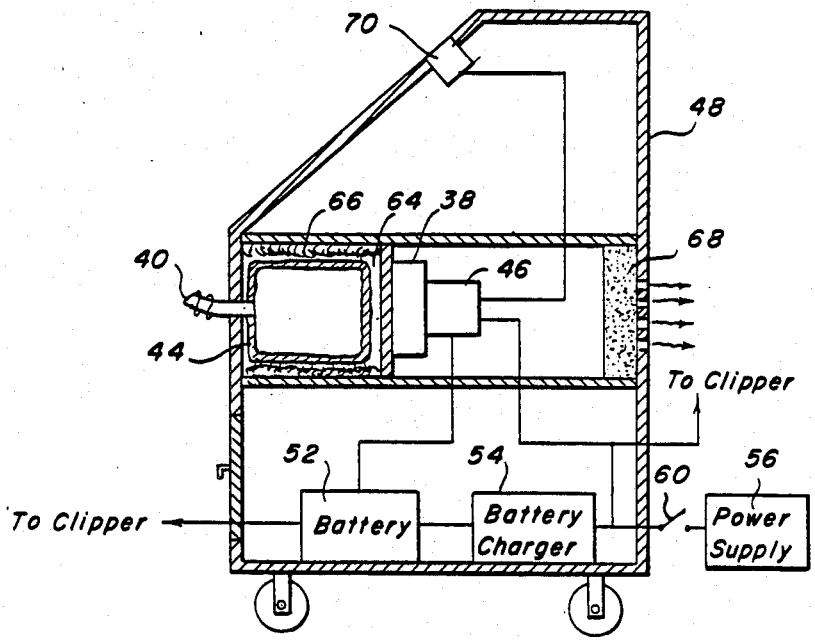
FIG. 7 is a cross-sectional view of the assembly of FIG. 6.
Figure 6:
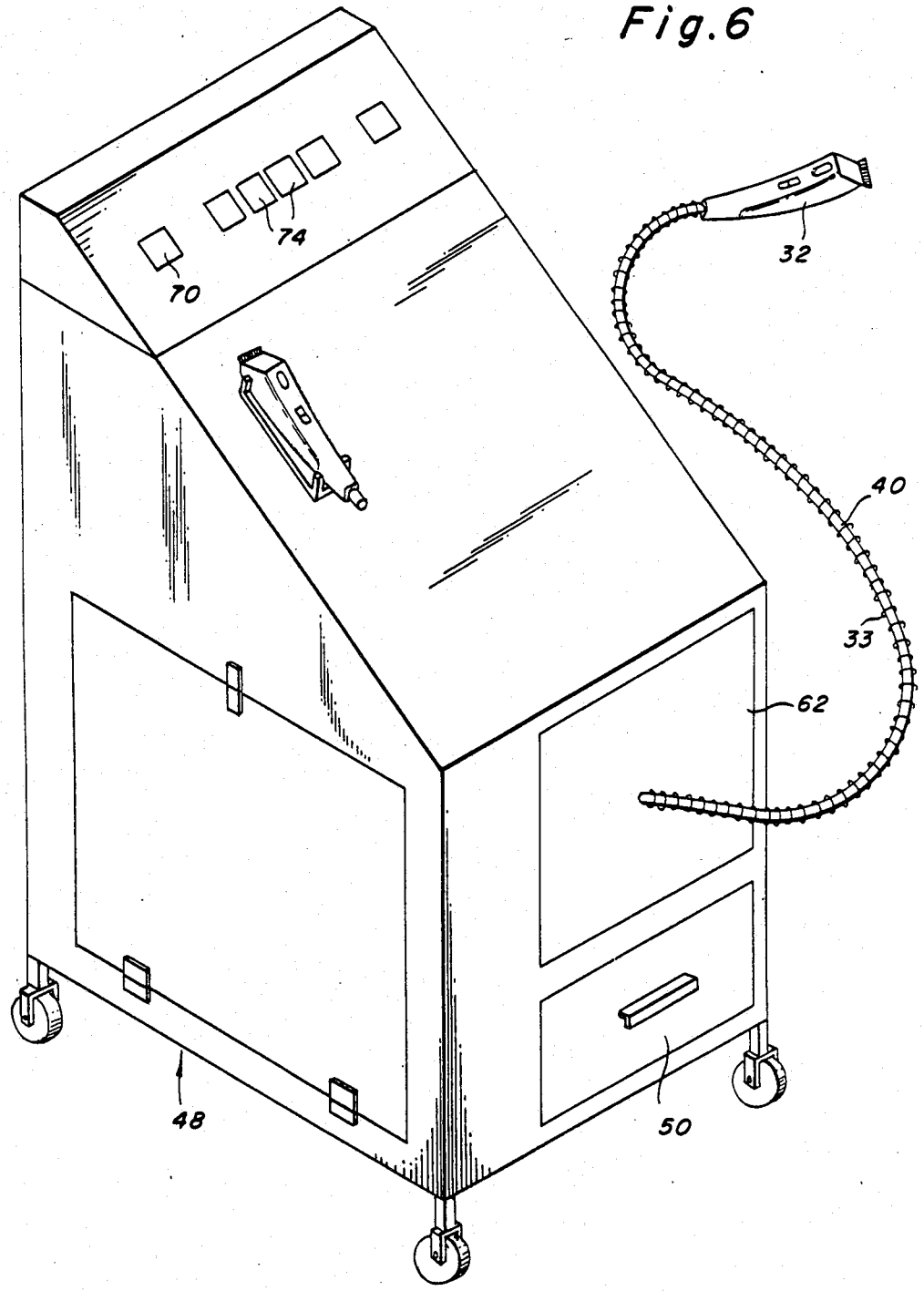
FIG. 6 is a perspective view of the combined clipper and vacuum assembly.

As shown in FIGS. 6 and 7, the vacuum assembly components are arranged in a mobile cabinet 48. The cabinet includes a bottom drawer 50 providing access to a battery 52 and battery charger 54 which may be used to operate the electric clipper and vacuum motor. An electric line connects the battery charger with a power supply 56, such as a conventional wall AC outlet, via a switch 60, whereby the combined clipper and vacuum assembly may be powered by the battery or by the AC power supply.

A top drawer 62 on the cabinet provides access to the disposble vacuum bag 46 arranged in a vacuum chamber 64 adjacent the vacuum source. Sound deadening insulation 66 is provided around the vacuum chamber. Exhaust air from the vacuum leaves the rear of the cabinet via a filter 68.

A switch assembly 70 is provided on the exterior of the cabinet to control the variable speed motor. Switch 72 is a power on switch which energizes the motor. Switches 74 set the various speeds of the motor to control the amount of suction delivered to the suction nozzle. The variation of the degree of suction provided at the suction nozzle is important depending upon the area of the body being clipped. For some tender areas, a low degree of suction is desirable to prevent undue irritation to the skin of the patient. In such areas, the tender skin may be drawn into the suction nozzle creating discomfort and additional trauma to a person about to undergo surgery.

Conversely, other areas of the body may require higher degrees of suction for efficient clipping of body hair, particularly where the hair is either excessively dense or long. In such areas, the higher suction may actually draw the hair on end prior to clipping, so that a close cut is provided without actually contacting the patient's skin.

Figure 8:
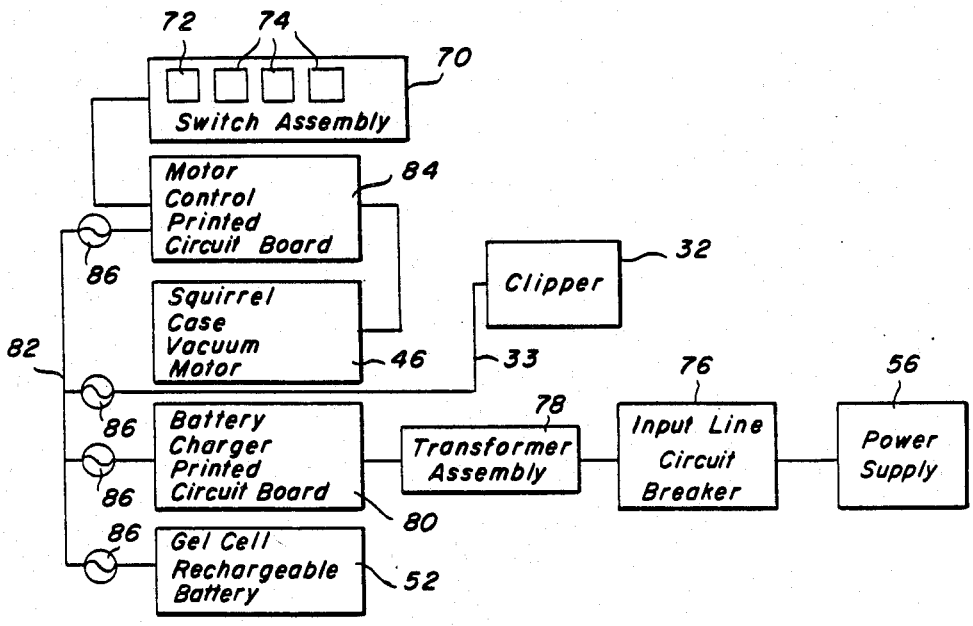
FIG. 8 is a block diagram of the electric circuit for operating the clipper and vacuum assembly.

FIG. 8 is a block diagram of the electrical supply circuit for the combined clipper and vacuum assembly. The power supply 56 is connected with an input line circuit breaker 76 which provides overcurrent protection to the motors of the clipper and vacuum. A transformer 78 provides both insulation and a stepped-down voltage with stepped-up current for safety and proper operation of low voltage circuits. The low voltage high current is passed to a battery charger printed circuit board 80 which regulates the charge to a gel cell rechargeable battery 52. Low voltage is transferred through the low voltage bus line 82 to the motor control printed circuit board 84 and to the clipper 32 through electric line 33. The motor control printed circuit board varies the current directed to the squirrel cage vacuum motor 46 according to the selection of the speed buttons 74 of the switch assembly 70. The motor control circuit board, the clipper, the battery charger circuit board, and the battery are all protected by fuses 86 placed on the low voltage bus line 82.

The disposable clipper head and combined clipper and vacuum assembly are suitable for use in any environment where it is desirable to painlessly cut hair. Thus the subject invention is suitable for use by a barber and by a verterinarian, as well as in the hospital environment described above.

While in accordance with the provisions of the Patent Statutes the preferred forms and embodiments have been illustrated and described, it will be apparent to those skilled in the art that various changes and modifications may be made without deviating with the inventive concepts set forth above.

What is claimed is:

1. A combined hair clipping and vacuum assembly for removing body hair from an individual such as in preparation for surgery and the like, comprising (a) a hair clipper;

(b) a disposable clipping head connected with said clipper for clipping strands of hair, said clipping head being formed of two pieces, comprising (1) a fixed member, including (i) a generally rectangular, planar base portion having one toothed edge;

(ii) spring means integrally connected with and extending from an upper planar surface of said base portion, said spring means including a forwardly extending portion spaced from and parallel with said surface and terminating at a forward edge spaced rearwardly from said toothed edge; and (iii) lug means integrally connected with and extending from an upper surface of said spring means, said lug means being adapted for interlocking attachment to the electric clipper; and (2) a movable member arranged between said fixed member base portion and spring means, said movable member having a generally rectangular planar configuration and one toothed edge arranged adjacent said fixed member toothed edge, the upper surface of said movable member containing a groove spaced from and parallel with said movable member toothed edge, said groove being adapted to receive said forward edge of said fixed member spring means, whereby said spring means retains and guides said movable member relative to said fixed member when said fixed member is attached to said clipper and said movable member is driven by said clipper for reciprocal movement to clip strands of hair between said adjacent toothed edges; and (c) vacuum means for removing strands of hair cut by said clipping head, said vacuum means including (1) a vacuum source;

(2) a nozzle mounted on said clipper and containing an opening arranged adjacent said clipping head;

(3) a suction hose arranged between said nozzle and said vacuum source, thereby to provide suction for said nozzle opening; and (4) means for controlling said vacuum source to vary the degree of suction provided for said nozzle opening, thereby to minimize discomfort to the individual.

* * * * *